US005246185A

United States Patent [19]

Vincent

[11] Patent Number: 5,246,185

[45] Date of Patent: Sep. 21, 1993

[54] RETAINER FOR FILAMENTARY MATERIAL WOUND ON A SPOOL

[76] Inventor: James D. Vincent, 180 Ridge St., Blackfoot, Id. 83221

[21] Appl. No.: 22,535

[22] Filed: Feb. 25, 1993

[51] Int. Cl.[5] ..... B65H 75/28; B65H 55/00

[52] U.S. Cl. ..... 242/125.3; 242/171; 242/172

[58] Field of Search ..... 242/125.3, 125, 125.1, 242/125.2, 170, 171, 172, 96, 99; 206/398, 400, 389, 409

[56] References Cited

U.S. PATENT DOCUMENTS

| | | | |
|---|---|---|---|
| 394,996 | 12/1888 | Pratt | 242/125.3 |
| 397,999 | 2/1889 | Pratt | 242/125.3 |
| 534,535 | 2/1895 | Walter | 242/125.3 |
| 583,176 | 5/1897 | Harvey | 242/125.3 |
| 693,854 | 2/1902 | Gamble | 242/125.3 |
| 954,562 | 4/1910 | Cone | 242/170 |
| 1,222,703 | 4/1917 | White | 242/125.3 |
| 2,647,625 | 8/1953 | Mason et al. | 242/125.3 X |

FOREIGN PATENT DOCUMENTS

| | | | |
|---|---|---|---|
| 1084077 | 6/1954 | France | 242/125.3 |
| 21553 | 4/1893 | United Kingdom | 242/125.3 |
| 10681 | 4/1913 | United Kingdom | 242/125.3 |
| 225706 | 12/1924 | United Kingdom | 242/125.3 |

*Primary Examiner*—Stanley N. Gilreath
*Attorney, Agent, or Firm*—Charles S. McGuire

[57] ABSTRACT

A retainer for use with a bobbin having filamentary material wound thereon to prevent unwanted unwinding of the material. The retainer is formed from a strip of elastic material with one end folded back upon an intermediate portion to form a minor loop, and the other end passed around and superposed with the first end to form a major loop. The three superposed layers in the areas of the intermediate portion and immediately adjacent the two ends are permanently secured and an opening therethrough defined by a grommet. The major loop is stretched to pass over the peripheral edge of the bobbin and engage the outer layer of filamentary material with the free end of the latter passing through the opening in the retainer.

7 Claims, 1 Drawing Sheet

RETAINER FOR FILAMENTARY MATERIAL WOUND ON A SPOOL

BACKGROUND OF THE INVENTION

The present invention relates to elastic retainers which maintain filamentary materials in a wound condition on a spool or bobbin while permitting convenient removal of desired lengths of such material and rewinding of unused portions thereof.

It is often desirable to provide means for retaining filamentary materials such as thread, cord or other types of line on a spool or bobbin to prevent unwanted unwinding thereof while permitting easy withdrawal of desired lengths of the material. To this end, a number of devices or structural combinations have been proposed, some of which are particularly directed to use with fishing tackle such as leader or tippet material, the field with which the present invention is primarily concerned.

Prior art in the field of fishing tackle retainers includes Harder U.S. Pat. No. 4,883,238, wherein an elastomeric ring is employed in combination with a stud having an enlarged head, and Spencer U.S. Pat. No. 4,998,685, which utilizes ordinary rubber bands to retain the line on the spool. Prior art in related fields includes Larson U.S. Pat. No. 4,542,863, relating to a retarding element for a reel of pipe-thread sealing tape, and Hansard et al U.S. Pat. No. 4,333,563, relating to a retaining device for motion picture film on a reel.

It is a principal object of the present invention to provide a novel and improved retaining element for filamentary material wound on a spool or bobbin which permits both easy removal of desired lengths of the material and rewinding of excess portions thereof.

A more specific object of the invention is to provide a simple and economical, elastic device for use with bobbins having filamentary fishing tackle materials wound thereon which retains the material in a securely wound condition while permitting fast and easy withdrawal and rewinding.

Other objects will in part be obvious and will in part appear hereinafter.

SUMMARY OF THE INVENTION

In accordance with the foregoing objects, the invention comprises a strip of suitable, elastic or elasticized material one end of which is folded back upon an intermediate portion of the strip to form a minor loop. The other end is superposed with the first end to form a major loop. The three superposed layers of material, i.e., the intermediate portion and the portions adjacent the ends, are joined and an opening extends through all three layers, the joining means and opening preferably provided by a metal or plastic grommet.

The device is intended for use with a bobbin or spool having a drum with a cylindrical surface upon which the filamentary material is wound between spaced, parallel flanges on each side. The material of the retainer has a width which is preferably about equal to the spacing between the flanges, but may be somewhat wider or narrower without seriously impairing operability. The circumference of the major loop in the unflexed condition of the elastic material is somewhat smaller than the circumference of the drum and thus of any layers of material which may be wound upon the drum. The major loop is stretched to the extent necessary to place it in surrounding relation to the wound material and between the bobbin flanges with the free end of the material extending through the opening in the superposed layers of the retainer. The filamentary material is thus prevented from unwinding except when the portion extending through the retainer opening is grasped and pulled, and any excess material may be quickly and easily rewound simply by grasping the minor loop of the retainer and passing it around the drum.

The foregoing and other features of construction and operation of the retainer element of the invention will be more readily understood and fully appreciated from the following detailed description, taken in conjunction with the accompanying drawing, wherein:

DETAILED DESCRIPTION

Figure 1:
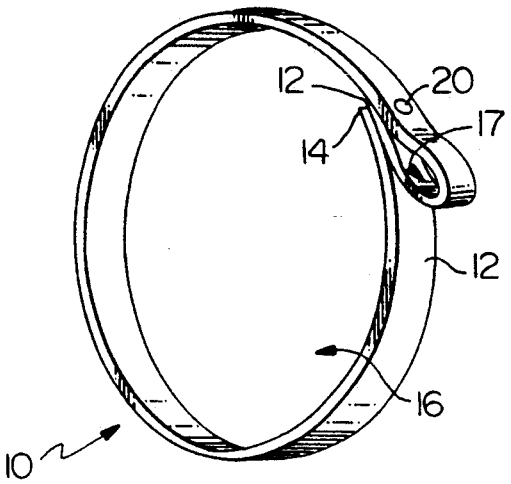
FIG. 1 is a perspective view of the preferred embodiment of the retainer.

The retainer, indicated generally by reference numeral 10, is formed from a single strip of any suitable elastic or elasticized material, such as Nylon-Lycra knit elastic, or the like. The strip has opposite ends 12 and 14, end 12 being folded back upon an intermediate portion of the strip to form minor loop 17. End 14 is then placed in superposed relation with end 12 under minor loop 17 to form major loop 16, resulting in three layers of the strip being superposed immediately adjacent ends 12 and 14. These three layers of material are permanently joined and an opening is formed, passing through all three layers. Preferably, the layers are joined by a metal or plastic grommet 20 which passes through the opening in the superposed layers and thus itself provides the opening in retainer 10.

Figure 2:
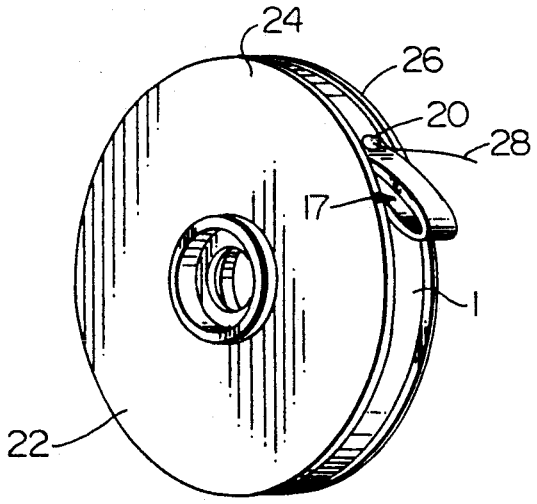
FIG. 2 is a perspective view of the retainer installed on a bobbin having a filamentary material wound thereon.

In FIG. 2, retainer 10 is illustrated in the installed condition on bobbin 22 having a drum with a cylindrical surface between spaced, parallel flanges 24 and 26. Bobbin 22 may be of the type disclosed in copending application Ser. No. 08/022,484 of the present inventor, filed of even date herewith, or with any other spool or bobbin of suitable configuration. A filamentary material, e.g., leader or tippet material used as fishing tackle, is wound upon the drum of bobbin 22. Relative dimensions of retainer 10 and bobbin 22 are such that major loop 16 has a circumference in the unflexed condition of the strip material which is somewhat less than that of the bobbin drum, and a width which is preferably about equal to the spacing between flanges 24 and 26.

Major loop 16 is stretched manually to the extent required to permit it to pass over one of flanges 24 and 26, and free end 28 of the filamentary material is passed through the opening in grommet 20. Loop 16 is then allowed to contract, firmly engaging the outer layer of filamentary material and thus preventing unwanted unwinding thereof. Material may, however, be easily removed from bobbin 22 by grasping free end 28 and pulling, resulting in retainer 10 slipping around the surface of the wound material. If excess material remains extending out of the retainer after the desired length has been cut, it may be easily rewound by grasping the portion of the retainer formed by minor loop 17 and passing the retainer around bobbin 22 while holding the latter stationary, or vice versa. Minor loop 17 preferably has a circumference of at least about one inch, thus providing superposed layers at least one-half inch in length for grasping.

What is claimed is:

1. A retainer for filamentary material wound on a cylindrical surface of a drum between spaced parallel flanges of a bobbin, said retainer comprising:

a) a strip of elastic material having first and second ends and a predetermined width;

b) said first end being folded back upon and superposed with an intermediate portion of said strip to form a minor loop extending from said first end to said intermediate portion;

c) said second end being superposed with one of said first end and said intermediate portion to form a major loop, significantly larger than said minor loop with three layers of said material mutually superposed in the areas of said intermediate portion and adjacent said first and second ends;

d) said major loop having a circumference in the unstretched condition somewhat smaller than that of said bobbin drum;

e) means permanently securing said three layers in mutually engaged relation; and f) means defining an opening extending through all of said three layers.

2. The retainer of claim 1 wherein said predetermined width is substantially equal to the distance between said bobbin flanges.

3. The retainer of claim 1 wherein said securing means comprises portions of a grommet.

4. The retainer of claim 3 wherein said opening is defined by said grommet.

5. The retainer of claim 1 wherein said first and second ends are directly superposed with surface portions of said strip immediately adjacent said first and second ends in mutual contact, and a surface portion immediately adjacent said first end in mutual contact with a surface of said intermediate portion.

6. The retainer of claim 5 wherein said retaining means comprises portions of a grommet extending through all of said three layers, and said opening is defined by said grommet.

7. The retainer of claim 6 wherein said minor loop has a circumference of at least about one inch.

* * * * *